US006012809A

United States Patent [19]

Ikeda et al.

[11] Patent Number: 6,012,809

[45] Date of Patent: Jan. 11, 2000

[54] INK JET PRINTING METHOD AND APPARATUS FOR PRACTICING SAID METHOD USING A PROCESSING LIQUID WITH ONE OR BOTH SURFACE PRINTING MODE

[75] Inventors: Kunihiko Ikeda, Kodaira; Shigeru Yoshimura, Yokohama, both of Japan

[73] Assignee: Canon Kabushiki Kaisha, Tokyo, Japan

[21] Appl. No.: 08/783,095

[22] Filed: Jan. 14, 1997

[30] Foreign Application Priority Data

Jan. 19, 1996 [JP] Japan ..... 8-007873
Dec. 16, 1996 [JP] Japan ..... 8-335560

[51] Int. Cl.[7] ..... B41J 2/01; B41J 29/38

[52] U.S. Cl. ..... 347/101; 347/104; 347/15; 347/16; 347/98; 347/96; 347/9

[58] Field of Search ..... 347/101, 104, 347/15, 16, 98, 96, 9

[56] References Cited

U.S. PATENT DOCUMENTS 5,742,301 4/1998 Ikeda ..... 347/9

*Primary Examiner*—Valerie Lund
*Attorney, Agent, or Firm*—Fitzpatrick, Cella, Harper & Scinto

[57] ABSTRACT

An ink jet printing apparatus enables a printing operation to be performed for both surfaces of a printing medium with the use of an ink jet head for ejecting ink. The apparatus comprises components for designating either a both surface printing mode or a one surface printing mode, for applying processing liquid to the printing medium, for reducing a quantity of ejection of ink to the printing medium, and for designating either the component for applying processing liquid or that for reducing ejection quantity in the case that the both surface printing mode is designated. Even in the case that the both surface printing mode is selected, the ink jet printing apparatus assures that excellent printing quality can always be maintained by selecting either of a processing liquid usage printing mode for applying processing liquid to the printing medium or a low density printing mode for reducing a quantity of ejection of ink to the printing medium in excess of the original ink ejecting quantity corresponding to image information.

19 Claims, 6 Drawing Sheets

INK JET PRINTING METHOD AND APPARATUS FOR PRACTICING SAID METHOD USING A PROCESSING LIQUID WITH ONE OR BOTH SURFACE PRINTING MODE

BACKGROUND OF THE INVENTION

FIELD OF THE INVENTION

The present invention relates to an ink jet printing method and an apparatus for practicing said method. More particularly, the present invention is intended to reduce an occurrence that a printed image is recognized on the rear surface of a printing medium when printing operation is performed for both surfaces of the printing medium.

Conventionally, from the viewpoint of saving of paper resources, it is desired that both surfaces of a printing medium are printed. Also with respect to the ink jet printing apparatus, there is a tendency that both surfaces of the printing medium are increasingly printed with ink. Since liquid ink is used for the ink jet printing apparatus, there arises a problem that the printed image is undesirably recognized on the rear surface of a printing paper depending on the kind of the printing paper. In view of the foregoing problem, the conventional ink jet printing apparatus performs each printing operation with a low density printing mode which assures that the printed image is not recognized on the rear surface of the printing paper.

One example of the structure of the conventional ink jet printing apparatus is schematically shown in FIG. 5. In detail, a plurality of printing papers 102 received in a paper cassette 101 are successively delivered one by one to an opposing pair of conveying rollers 106 through paper guides 104 and 105 by rotating a paper feeding roller 103. Subsequently, each printing paper 102 is conveyed onto a platen 10 by the conveying rollers 106. A carriage 110 is engaged with the carriage driving shaft 108. The carriage 110 can reciprocably move in the direction of a width of the printing paper 102 along a guide rail 109 extending in parallel to a carriage driving shaft 108. The carriage driving shaft 108 having a feeding screw mechanism used therefor is rotated, accordingly the carriage 110 is driven for the purpose of scanning. To eject ink to a printing paper 102 on the platen 107, an ink jet head 111 is attached to the carriage 110.

It is also possible that a toothed belt is used in place of the feeding screw mechanism for driving the carriage 110.

The printing paper 102 of which one surface is printed by the ink jet head 111 is conducted to a change-over flapper 113 by a pair of paper discharging rollers 112. Here, in the case that a both surface printing mode is selected, the printing paper 102 is delivered into a reversible pocket portion 116 via a reversible conveying passage 114 by an opposing pair of reversible rollers 115. When a guide flapper 117 is turned to the shown position identified by a dotted line and the reversible rollers 115 are rotated in the reverse direction, the printing paper 102 is delivered to a reconveying passage 118 from the reversible pocket portion 116. Further, the printing paper 102 is fed onto the platen 107 by the conveying rollers 106. A printing operation is performed by the ink jet head 111 to the surface of the printing paper 102 located opposite to the surface which is previously printed with ink. Thereafter, the printing paper 102 of which both surfaces are already printed is conducted to the change-over flapper 113 turned to the shown position identified by a dotted line in the same manner as the printing paper 102 of which one surface is printed while the one surface printing mode is selected. Then, the printing paper 102 is conveyed to a paper discharging tray 120 via a paper discharging passage 119 by the paper discharging rollers 112.

A process of printing operations as mentioned above is shown in FIG. 6. In detail, when a power source switch (not shown) is shifted to ON side, a high quality printing mode (hereinafter referred to as HQ mode) and a one surface printing mode with which only one surface of the printing paper 13 is printed are automatically set. It should be noted that the HQ mode represents a mode with which the ink density is not lowered, that is, a mode with which an ink ejection quantity is set to an original ink ejection quantity corresponding to image information but a printing speed is not increased to a high speed.

Determination is made at a step S1 as to whether a both surface printing mode is selected or not. In the case that determination is made at the step S1 such that the both surface printing mode is not selected, the program goes to a step S2 at which ink density is lowered, that is, the present ink ejection quantity is reduced less than an original ink ejection quantity corresponding to image information. In addition, determination is made whether a high speed printing mode for increasing the printing speed to a higher one (hereinafter referred to as HS mode) is selected or not. In the case that determination is made at the step S2 such that the HS mode is not selected, the program goes to a step S3 at which one surface printing operation is performed for the printing paper 102 with the HQ mode.

On the other and, in the case that determination is made at the step S1 such that the both surface printing mode is selected, the program goes to a step S4 at which the both surface printing mode is set for the ink jet printing apparatus. Then, determination is made at a step S5 as to whether the HS mode is selected or not. In the case that determination is made at the step S5 such that the HS mode is selected, the program goes to a step S6 at which both surface printing operation is performed for the printing paper 102 with the HS mode having few occurrences that printed image is recognized on the rear surface of the printing paper 102.

In the case that determination is made at the step S2 such that the HS mode is selected, the program goes to the step S6 at which one surface printing operation is performed for the printing paper 102 with the HS mode having few occurrences that printed image is recognized on the rear surface of the printing paper. In addition, in the case that determination is made at the step S5 such that the HS mode is not selected, the program goes to the step S3 at which both surface printing operation is performed for the printing paper 102 with the HQ mode which takes preference of printing quality over prevention of an occurrence that printed image is recognized on the rear surface of the printing paper 102.

In the conventional ink jet printing apparatus shown in FIG. 5 and FIG. 6, in the case that both surface printing operation is performed for the printing paper 102, it is necessary that printing operation is performed with the HS mode in order to suppress an occurrence that printed image is recognized on the rear surface of the printing paper 102. However, when printing operation is performed with the HS mode, there arises a problem that sharpness of the printed image becomes insufficient as printing density is lowered, and consequently, excellent printing quality can not be obtained. Accordingly, in case that the printing density is set to a usual high density in order to maintain the sharpness of printed image, there intensely appears a phenomenon that the printed image is recognized on the rear surface of the printing paper. At any rate, the conventional ink jet printing apparatus has a difficulty that excellent printing quality is hardly assured.

SUMMARY OF THE INVENTION

An object of the present invention is to provide an ink jet printing apparatus and a method of practicing said method each of which can always assure excellent printing quality even in the case that printing operation is performed for both surfaces of a printing medium.

According to a first aspect of the present invention, there is provided an ink jet printing method of enabling a printing operation to be performed for both surfaces of a printing medium with the use of an ink jet head for ejecting ink, comprising:

a step of selecting either a both surface printing mode or a one surface printing mode, and a step of selecting either a processing liquid usage printing mode for applying processing liquid to the printing medium in the case that the both surface printing mode is selected or a low density printing mode for reducing a quantity of ejection of the ink to the printing medium.

Here, the processing liquid usage printing mode of the ink jet printing method according to the first aspect of the present invention may include a high density printing mode with which a quantity of ejection of ink to the printing medium is not reduced.

The low density printing mode may include a processing liquid non-usage printing mode with which the processing liquid is not applied to the printing medium.

In addition, the processing liquid may serve to suppress penetration of the ink into the printing medium or it may serve to promote coagulation of the ink.

The ink jet printing method may comprise a step of heating the printing medium when the processing liquid is applied to the printing medium and/or a painting operation is performed with the ink.

Additionally, the processing liquid may be applied to the printing medium before the printing operation is performed with the ink. In this case, the ink jet printing method may include a step of preheating the printing medium before the processing liquid is applied to the printing medium in the case that the printing liquid usage printing mode is selected.

Since the ink jet printing method of the present invention further includes a step of selecting either of a processing liquid usage printing mode for applying the processing liquid to the printing medium or a low density printing mode for lowering the density of ink to be applied to the printing medium in the case that the both surface printing mode is selected, a printing operation can be performed by reducing an ink ejecting quantity in excess of the ink ejection quantity corresponding to original image information without any occurrence that the printed image is recognized on the rear surface of the printing medium while the ink density is lowered. In addition, the printing operation can be performed by applying the processing liquid to the printing medium with high ink density, high image sharpness and high image quality without any occurrence that the printed image is recognized on the rear surface of the printing medium.

Since drying of the processing liquid is promoted in the case that the printing medium is preheated before the processing liquid is applied to the printing medium, the processing liquid is not scattered away from the printing medium when ink is ejected from an ink jet head, whereby contamination of the ink jet head with scattered ink droplets can be prevented.

Further, in the case that the printing medium is heated when the processing liquid is applied to the printing medium and/or when a printing operation is performed with ink, drying of the processing liquid and the ink is promoted, whereby excellent printing quality can be maintained.

Next, according to a second aspect of the present invention, there is provided an ink jet the printing apparatus enabling printing operation to be performed for both surfaces of a printing medium with the use of an ink jet head for ejecting ink, comprising:

a printing surface designating means for designating either a both surface printing mode or a one surface printing mode, a processing liquid applying means for applying processing liquid to the printing medium, a density changing means for reducing a quantity of ejection of the ink to the printing medium, and a processing liquid and density designating means for designating either of the processing liquid applying means or the density changing means in the case that the printing surface designating means designates the both surface printing mode.

When the processing liquid applying means is designated by the processing liquid and density designating means in the case that a both surface printing mode is designated by the printing surface designating means, processing liquid is applied to the printing medium. This causes the ink to be hardly penetrated into the printing medium, whereby the printed image formed on the rear surface of the printing medium is not remarkably recognized. In addition, when density changing means is designated by the processing liquid and density designating means with a both surface printing mode, a quantity of ejection of ink to the printing medium is reduced, whereby a quantity of the ink penetrated into the printing medium is reduced and the printed image formed on the rear surface of the printing medium is not remarkably recognized.

The density changing means in the ink jet printing apparatus according to the second aspect of the present invention may serve to reduce an ink ejection quantity to the printing medium in excess of the original ink ejection quantity corresponding to image information.

In the case that processing liquid applying means is designated by the processing liquid and density designating means, the density changing means may serve to maintain the ink ejection quantity to the printing medium at the original ink ejection quantity corresponding to the image information. On the contrary, in the case that the density changing means is designated by the processing liquid and density designating means, the liquid applying means does not apply the processing liquid to the printing medium.

The processing liquid may be a liquid which suppresses penetration of the ink into the printing medium or it may be a liquid which promotes coagulation of the ink.

The ink jet printing apparatus may further include a main heater for heating the printing medium when the processing liquid is applied to the printing medium and/or when a printing operation is performed with the ink.

Additionally, the processing liquid may be a liquid which is applied to the printing medium before the printing operation is performed with the ink. In this case, the ink jet printing apparatus may include a preheater for preheating the printing medium before the processing liquid is applied to the printing medium.

An ink jet head may move for the purpose of scanning along the printing medium in the direction intersecting the transporting direction of the printing medium or it may simultaneously eject ink over the whole width of the printing range of the printing medium.

Since the processing liquid and density designating means is arranged on the ink jet printing apparatus of the present invention for designating either processing liquid applying means or density changing means in the case that a both surface printing mode is designated by printing surface designating means, a quantity of penetration of the ink into the printing medium can be reduced by reducing an ink ejection quantity in excess of the ink ejection quantity corresponding to original image information, whereby printed image formed on the rear surface of the printing medium can not remarkably be recognized. Further, the ink can hardly be penetrated into the printing medium by applying the processing liquid to the printing medium, and printed image formed on the rear surface of the printing medium can not remarkably be recognized.

In addition, since drying of the processing liquid is promoted in the case that a preheater is arranged on the ink jet printing apparatus for preheating the printing medium before the processing liquid is applied to the printing medium, the processing liquid is not scattered when ink is ejected to the printing medium from an ink jet head so that contamination of the ink jet head with scattered ink droplets can be prevented.

Further, in the case that a main heater is arranged on the ink jet printing apparatus for heating the printing medium when the processing liquid is applied to the printing medium and/or when a printing operation is performed with the ink, drying of the processing liquid and the ink is promoted, whereby excellent printing quality can be maintained.

DETAILED DESCRIPTION OF THE PREFERRED EMBODIMENT

The present invention will be described in detail with reference to FIG. 1 to FIG. 4 which illustrate an embodiment of an ink jet printing apparatus for practicing an ink jet printing method according to the present invention.

Figure 1:
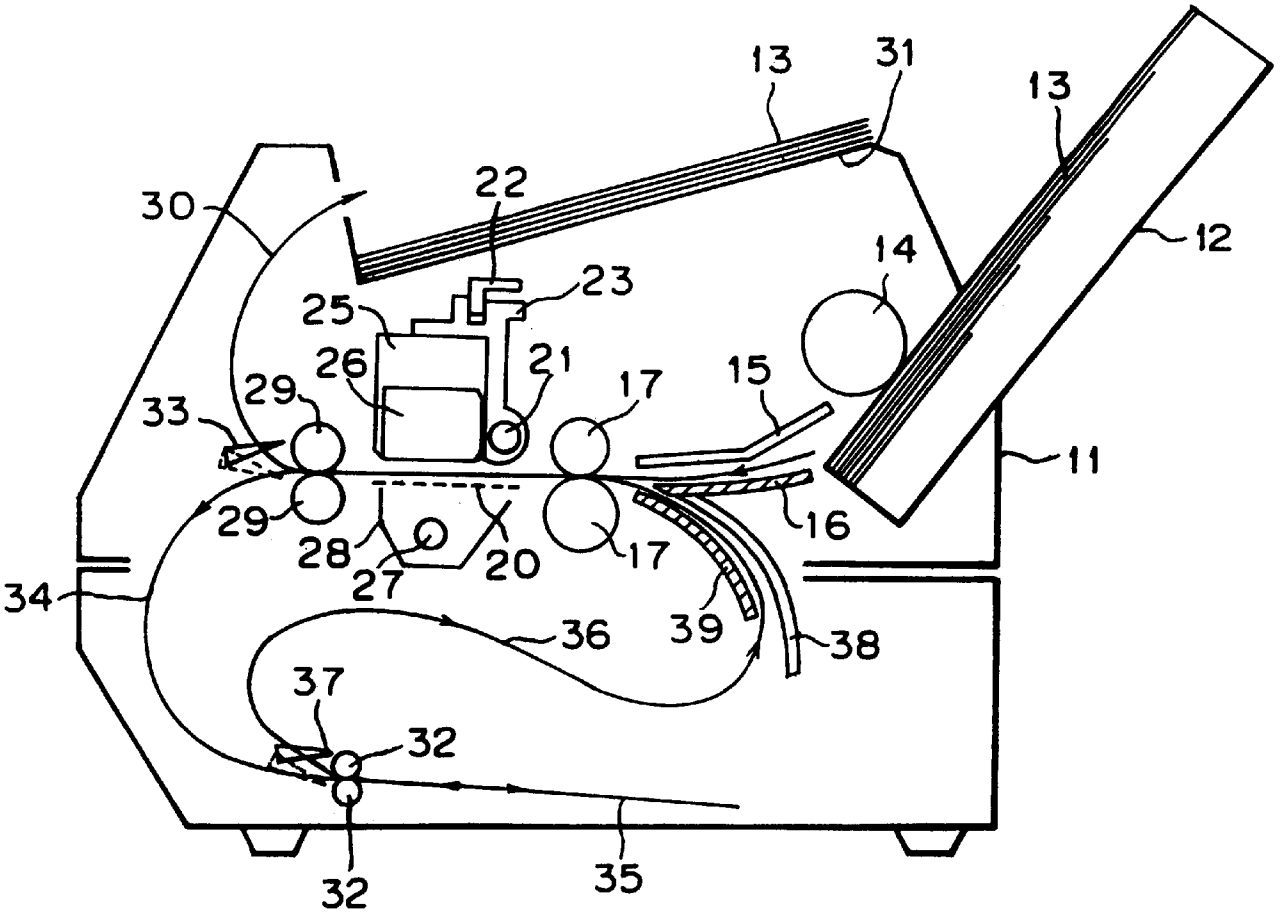
FIG. 1 is a vertical sectional view schematically showing the structure of an ink jet printing apparatus constructed in accordance with an embodiment of the present invention.
Figure 2:
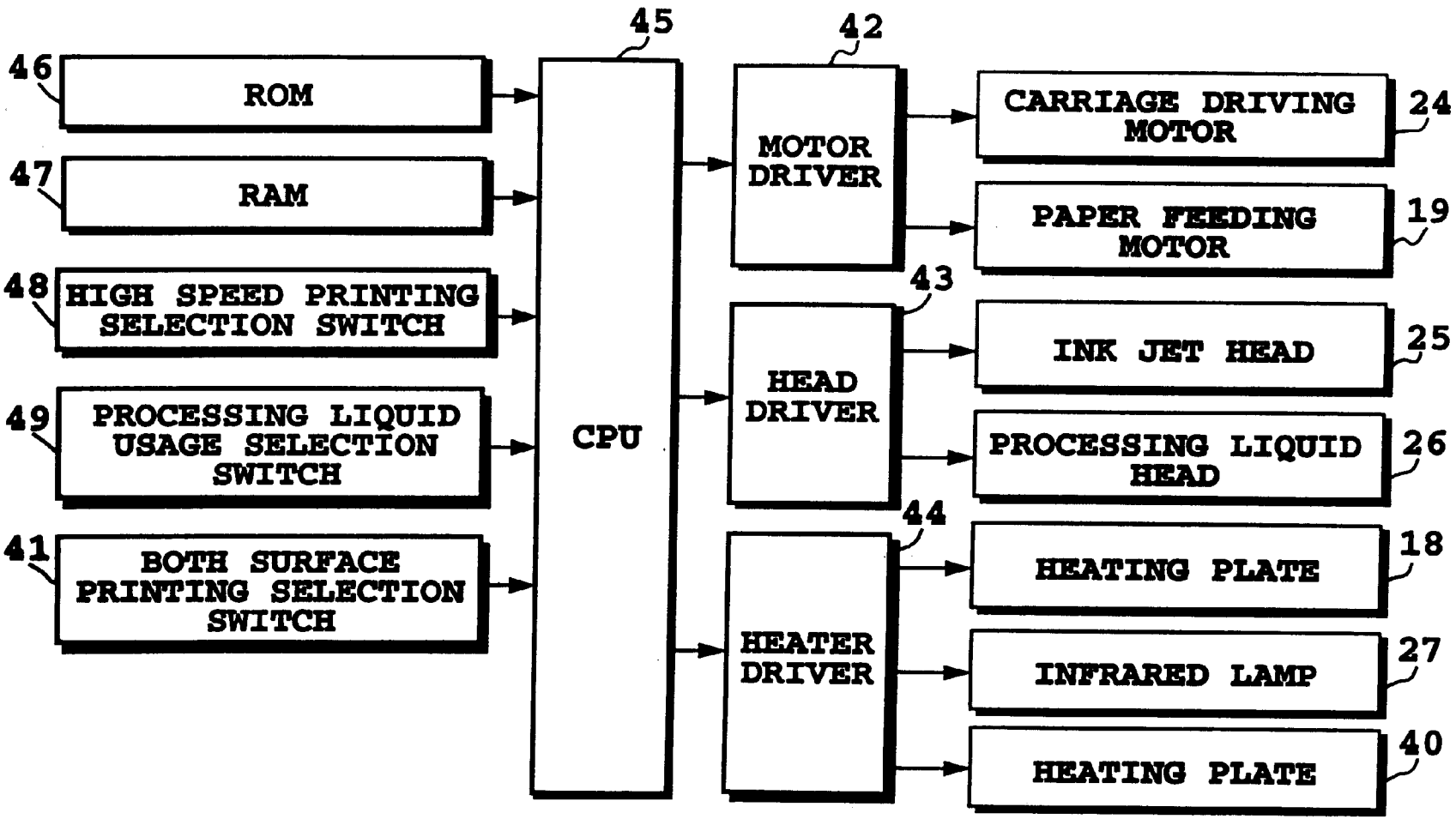
FIG. 2 is a control block diagram for performing printing operations in accordance with the embodiment shown in FIG. 1.

A schematic structure of the ink jet printing apparatus according to a first embodiment of the present invention is shown in FIG. 1 and control blocks of the ink jet printing apparatus are shown in FIG. 2. In detail, a plurality of printing papers 13 each having predetermined sizes are received in a paper cassette 12 which is detachably inserted into a housing 11. The printing papers 13 are delivered one by one to the interior of the housing 11 between an opposing pair of conveying rollers 17 by a paper feeding roller 14 adapted to be intermittently rotated after each of the printing papers 13 passes past the space defined by an opposing pair of paper guides 15 and 16.

A heating plate 18 which functions as a preheater for carrying out the present invention is adhesively attached to the surface of the lower paper guide 16. According to the first embodiment of the present invention, the heating plate 18 is formed by a polyimide film having an electric resistance heating pattern placed thereon. The rear surface of the printing paper 13 delivered from the paper cassette 12 comes in slidable contact with the heating plate 18. As the heating plate 18 is turned on, it is heated to a temperature ranging between 80 to 100° C., and the printing paper 13 is preheated to about 70° C. while it passes on the paper guide 13. This causes the processing liquid applied to the printing paper 13 to be promotively dried while preventing the printing paper 13 from shrinking. Thus, deterioration of a printing quality of the printing paper 13 can be prevented when an ink is applied to the printing paper 13.

A flat plate-like platen 20 for holding the printing paper 13 from the rear surface side is arranged on the downstream side of the conveying rollers 17 adapted to be rotationally driven by a paper feeding motor 13. Each printing paper 13 is intermittently transported onto the platen 20 by a predetermined length as the conveying rollers 17 are rotated. A carriage 23 reciprocably movable in the direction of a width of the printing paper 13 (in the vertical direction relative to the paper surface as seen in the drawing) along a guide rail 22 arranged in parallel to a carriage driving shaft 21 is engaged with the carriage driving shaft 21 which extends in parallel to the platen 20. The carriage 23 is driven for the purpose of scanning in the direction at a right angle relative to the feeding direction of the printing paper 13 as the carriage driving shaft 21 operatively connected to a carriage driving motor 24 is rotated. An ink jet head 25 for ejecting the ink to the printing paper 13 placed on the platen 20 and a processing liquid head 26 for ejecting the processing liquid to the printing paper 13 as required are exchangeably arranged on the carriage 23 along the moving direction of the carriage 23.

According to the first embodiment of the present invention, the ink jet head 25 includes ejecting energy generating means (not shown) for ejecting the ink from a plurality of fine ejecting openings by heating the ink received in a part of each of a plurality of ink passages by electric resistance heating elements disposed at a part of each ink passage having an ejecting opening formed thereon.

In addition, the processing liquid head 26 serves to eject the transparent processing liquid for suppressing penetration of the ink into the printing paper 13 and causing the ink itself to coagulate before a printing operation is performed by the ink jet head 25. Basic structure of the processing liquid head 26 is same as that of the ink jet head 25.

The above-mentioned processing liquid contains, e.g., a cation activating agent. In the case that a printing operation is performed after the printing paper 13 is coated with the processing liquid, an extent of penetration of the ink into the printing paper 13 is reduced. Consequently, an occurrence that printed image is recognized on the rear surface of the printing paper 13 can be reduced. Here, as an example, the processing liquid or solution for making ink dyestuff insoluble can be obtained in the following manner.

Specifically, after the following components are mixed together, dissolved, and the mixture is pressure-filtered by using a membrane filter of 0.22 μm in pore size (tradename: Fuloropore filter manufactured by Sumitomo Electric Industries, Ltd.), and thereafter, the pH of the mixture is adjusted to a level of 4.8 by adding sodium hydroxide whereby liquid A1 can be obtained.

[components of A1]

| | |
|---|---|
| low molecular weight ingredients of cationic compound; stearyl-trimethyl ammonium salts (tradename: Electrostriper QE, manufactured by Kao Corporation), or stearyl-trimethyl ammonium chloride (tradename: Yutamine 86P, manufactured by Kao Corporation) | 2.0 parts by weight |
| high molecular weight ingredients of cationic compound; copolymer of diarylamine hydrochloride and sulfur dioxide (having an average molecular weight of 5000) (tradename: polyaminesulfon PAS-92, manufactured by Nitto Boseki Co., Ltd) | 3.0 parts by weight |
| thiodiglycol: | 10 parts by weight |
| water | balance |

Preferable examples of ink which become insoluble by mixing the aforementioned processing liquid A1 are noted below.

Specifically, the following components are mixed together, the resultant mixture is pressure-filtered with the use of a membrane filter of 0.22 μm in pore size (tradename: Fluoropore filter, manufactured by Sumitomo Electric Industries, Ltd.) so that black ink BK1, yellow ink Y1, magenta ink M1 and cyan ink C1 can be obtained.

| | |
|---|---|
| C. I. food black 2 | 3 parts by weight |
| thiodiglycol | 10 parts by weight |
| acetynol EH (tradename: manufactured by Kawaken Fine Chemical Co., Ltd.) | 0.05 parts by weight |
| water | balance |

[Yellow ink Y1]

having the same composition as that OJ BK1 other than that the dyestuff is changed to 2 parts by weight OJ C. I. direct yellow 142.

[Magenta ink M1]

having the same composition as that of BK1 other than that the dyestuff is changed by 2.5 parts by weight of C. I. acid red 289.

[Cyan ink C1]

having the same composition as that of BK1 other than that the dyestuff is changed to 2.5 parts by weight of acid blue 9.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the processing liquid A1 previously discussed.

As mentioned below, black ink BK2, yellow ink Y2, magenta ink M2 and cyan ink C2 each containing pigment and anionic compound can be obtained.

[Black ink BK2]

The following materials are poured in a batch type vertical sand mill (manufactured by Aimex Co.), glass beads each having a diameter of 1 mm are filled as media using anion based high molecular weight material P-1 (aqueous solution containing a solid ingredient of styrene methacrylic acid ethylacrylate of 20% having an acid value of 400 and average molecular weight of 6000, neutralizing agent: potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

| (Composition of carbon black dispersing element) | |
|---|---|
| P-1 aqueous solution (solid ingredient of 20%) | 40 parts |
| carbon black (tradename: Mogul L manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow ink Y2]

Anionic high molecular P-2 (aqueous solution containing a solid ingredient of 20% of stylenacrylic acid methyl methaacrylate having an acid value of 280 and an average molecular weight of 11,000, neutralizing agent: diethanolamine) is used as a dispersing agent and dispersive treatment is conducted in the same manner as production of the black ink BK2 whereby yellow color dispersing element having a weight-average grain size of 103 nm is produced.

| (composition of yellow dispersing element) | |
|---|---|
| P-2 aqueous solution (having a solid ingredient of 20%) | 35 parts |
| C. I. pigment yellow 180 (tradename: Nobapalm yellow PH-G, manufactured by Hoechst Aktiengesellschaft) | 24 parts |
| triethylene glycol | 10 parts |
| diethylene glycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Magenta ink M2]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

| (composition of the magenta colored dispersing element) | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

[Cyan ink C2]

Cyan colored-dispersant element having a weight-average grain size of 120 nm is produced by using the anionic high molecular P-1 used when producing the black ink BK2 as dispersing agent, and moreover, using the following materials by conducting dispersing treatment in the same manner as the carbon black dispersing element.

| (composition of cyan colored-dispersing element) | |
|---|---|
| P-1 aqueous solution (having solid ingredient of 20%) | 30 parts |
| C. I. pigment blue 153 (tradename: Fastogen blue FGF, manufactured by Dainippon Ink And Chemicals, Inc.) | 24 parts |
| glycerin | 15 parts |
| diethylene glycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

According to the present invention, the aforementioned processing liquid and ink are mixed with each other at the position on the printing paper 13 or at the position where they penetrate in the printing paper 13. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printing paper 13. As a result, only the liquid portion separated from the solid portion permeates into the printing paper 13, whereby both high print quality and a quick fixing property are obtained.

At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistance of a formed image is complete. In addition, light resistance of the formed image can be improved by the shielding effect of polymer.

By the way, the term "insoluble" or "aggregation" refers to observable events in only the above first stage or in both the first and second stages.

When the present invention is carried out, since there is no need of using the cationic material having a high molecular weight and polyvalent metallic salts like the prior art or even if there is need of using them, it is sufficient that they are assistantly used to improve an effect of the present invention, so a quantity of usage of them can be minimized. As a result, the fact that there is no reduction of a property of color exhibition that is a problem in the case that an effect of water resistance is asked for by using the conventional cationic high molecular weight material and the polyvalent metallic salts can be noted as another effect of the present invention.

With respect to the printing paper 13 usable for carrying out the present invention, there is no specific restriction; so called plain paper such as copying paper, bond paper or the like conventionally used can preferably be used. Of course, coated paper specially prepared for ink jet printing and OHP transparent film are also preferably used. In addition, ordinary high quality paper and bright coated paper can preferably be used.

According to the present invention, a main heater including an infrared lamp 27 and a heat reflecting plate 28 is arranged on the opposite side relative to the ink jet head 25 and the processing liquid head 26, i.e., just below the platen 20. In the shown embodiment, the platen 20 is formed by a punching metal or a net-shaped plate in order to transmit heat energy from the infrared lamp 27 and the heat reflecting plate 28 at a high efficiency.

The printing paper 13 placed on the platen 20 is heated up to over one hundred °C. by activating the infrared lamp 27 when a printing operation is performed by the ink jet head 25. This causes the moisture in the ink to be quickly vaporized so that fixing of the ink onto the printing paper 13 is hastened. Consequently, contamination of a printing image due to contact of the surface of the printing paper 13 with the transporting system for the printing surface 13 on the downstream side relative to the platen 20 can preventively be reduced. In the case that the infrared lamp 27 is activated when the processing liquid is applied to the ink jet head 25 from the processing liquid head 26, the moisture of water in the processing liquid ejected to the surface of the printing paper 13 from the processing liquid head 26 is quickly vaporized. As a result, a reduced amount of processing liquid is rebounded from the printing paper 13 when the ink is ejected from the ink jet head 25. Therefore, contamination of the ink jet head 25 induced by the rebounding of the processing liquid can be suppressed.

An opposing pair of paper discharging rollers 29 are rotatably arranged on the downstream side relative to the platen 20. In addition, a change-over flapper 33 is turnably arranged on the downstream side of the paper discharging rollers 29. The change-over flaper conducts via a paper discharging passage 30 the printing paper 13 discharged from the paper discharging rollers 29 onto a paper discharging tray 31 formed on the upper end part of the housing 11 or conducts the printing paper 13 to an opposing pair of reversible rollers 29 rotatably disposed below the paper discharging rollers 32. A reversible conveying passage 34 for conducting the printing paper 13 to the reversible roller 32 side is formed between the change-over flapper 33 and the reversible rollers 32.

As the reversible rollers 32 are rotated in the normal direction, the printing paper 13 conveyed from the paper discharging rollers 29 via the change-over flapper 33 and of which one surface is already subjected to printing operation is temporily held on a reversible pocket portion 35. Thereafter, to assure that both surfaces of the printing paper 13 of which one surface is already subjected to printing operation are printed, the printing paper 13 temporarily held on the reversible pocket portion 35 is drawn from the latter by rotating the reversible rollers 32 in the reverse direction. A guide flapper 37 is turnably disposed on the opposite side relative to the reversible pocket portion 35 while the reversible rollers 32 are located between the guide flapper 37 and the reversible pocket portion 35. The guide flapper 37 serves to conduct the printing paper 13 to a reconveying passage 36 formed between the reversible roller 32 and the conveying rollers 17 as the printing paper 13 is drawn from the reversible pocket portion 35.

A pair of paper guides 38 and 39 for guiding the movement of the printing paper 13 from the reconveying passage 36 to the conveying rollers 17 side are arranged on the downstream end part of the reconveying passage 36. According to the present invention, a heating plate 40 functioning as a preheater is adhesively attached to the front surface of the one paper guide 39 located on the inside relative to the reconveying passage 36. In the shown embodiment, the heating plate 40 is constructed in the same manner as the aforementioned heating plate 18. The surface of the printing paper 13 which is already subjected to printing operation comes in slidable contact with the heating plate 40. As the heating plate 40 is turned on, it is heated up to a temperature ranging from 80 to 100° C. so that the printing paper 13 is preheated to about 70° C. This causes the processing liquid applied again to the printing paper 13 to be promotively dried while preventing the printing paper 13 from shrinking. Thus, deterioration of printing quality of the printing paper 13 due to the repeated application of the ink can be prevented.

Thereafter, the printing paper 13 of which one surface is already subjected to printing operation is conducted to the change- over flapper 33 by rotating the paper discharging rollers 29. In the case that both surface printing mode is selected while a both surface printing selection switch 41 disposed on an operation panel (not shown) on the housing 11 is shifted to ON, the change-over flapper 33 is shifted to the shown position identified by the solid line. At this time, the printing paper 13 is introduced into the reversible pocket portion 35 via the reversible conveying passage 34 by rotating the reversible rollers 32. Thereafter, the guide flapper 37 is turned from the shown position identified by the solid line to the shown position identified by the dotted line, and then, the printing paper 13 is delivered to the reconveying passage 36 side from the reversible pocket portion 35 by rotating the reversible rollers 32 in the reverse direction. The printing paper 13 delivered to the conveying passage 36 is again fed onto the platen 20 while the movement of the printing paper 13 is guided by the paper guides 38 and 39. Then, a printing operation is performed by the ink jet head 25 for the surface of the printing paper 13 located on the opposite side relative to the surface which is previously printed. Thereafter, the movement of the printing paper 13 of which both surfaces are already subjected to printing operation is guided to reach the change-over flapper 33 shifted to the shown position identified by the dotted line so that the printing paper 13 is conveyed to the paper discharging tray 31 via the paper discharging passage 30 by rotating the paper discharging rollers 29. In such manner, a plurality of printing papers 13 are successively superimposed on the paper discharging tray 31.

It should be noted that in the case that the both surface printing mode is selected, the processing liquid is applied to the printing paper 13 by the processing liquid head 26 before the printing operation is performed for each surface of the printing paper 13. However, the processing liquid may be applied to the printing paper 13 from the processing liquid head 26 only in the case that a printing operation is performed for one of the surfaces of the printing paper 13 depending on properties of the processing liquid.

On the other side, in the case that one surface printing mode is selected while the both surface printing selection switch 41 is shifted to OFF, the movement of the printing paper 13 of which one surface is subjected to printing operation is guided to the change-over flapper 33 turned to the shown position identified by the dotted line so that the printing paper 13 is conveyed to the paper discharging tray 31 via the paper discharging passage 30 by rotating the paper discharging rollers 29. A plurality of printing papers 13 are successively superimposed on the paper discharging tray 31. In this case, there does not arise a necessity that the processing liquid is applied to each printing paper 13.

Operations of the heating plate 18, the paper feeding motor 1, the carriage driving motor 24, the ink jet head 25, the processing liquid head 26, the infrared lamp 27 and the heating plate 40 are controlled by a CPU via a motor driver 42, a head driver 43 and a heater driver 44. In other words, the CPU 45 executes control processing, data processing or the like for respective sections of the ink jet printing apparatus. Processing routines to be explained below are stored in a ROM 46, and a RAM 47 is connected to the CPU 45 as a work area for executing these processings.

A high speed printing selection switch 48 for reducing an ink ejecting quantity in excess of the ink ejecting quantity corresponding to an original image information and at the same time increasing a printing speed to a high one by printing various kinds of cut information, a processing usage selection switch 49 for changing the usage of the processing liquid head 26 and so forth are arranged on the operation panel on which the both surface printing selection switch 41 is also arranged. ON/OFF signals are outputted to the CPU 45 by actuating these switches with an operator's hand. Before a printing operation is performed for the printing paper 13, the CPU 45 selects one of a printing mode for performing a printing operation with high quality without any reduction of ink ejecting quantity as well as any increase of printing speed as long as ON signal is not outputted from these switches 41, 48 and 49 (hereinafter referred to as HQ mode), a printing mode for performing a printing operation only for one surface of the printing paper 13 and a printing mode for performing a printing operation without any use of the processing liquid.

Figure 3:
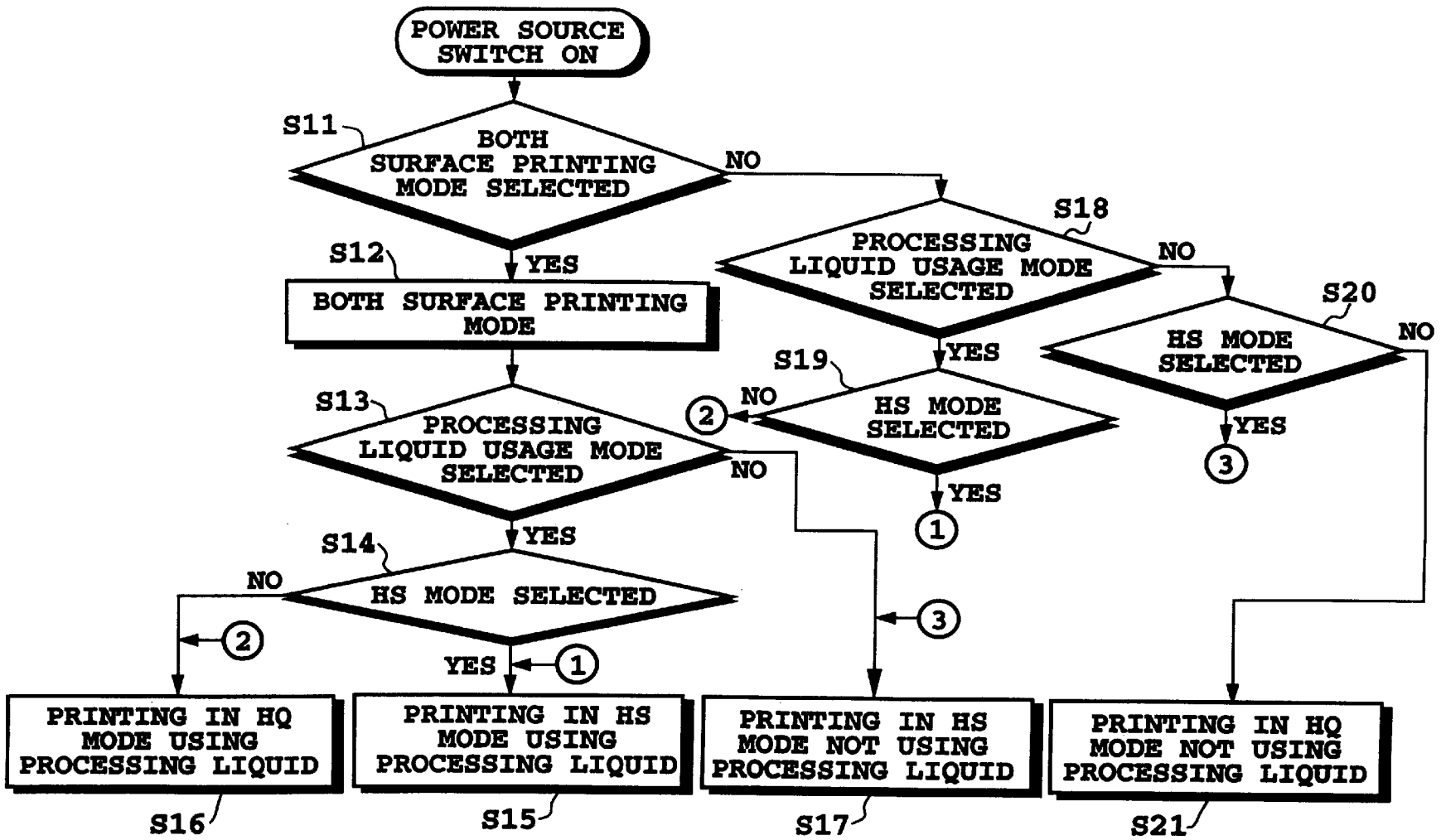
FIG. 3 is a flowchart showing a flow of printing operations to be performed in accordance with the embodiment shown in FIG. 1.

A flow of operations to be performed according to the aforementioned embodiment is shown in FIG. 3. In detail, when a power source switch which is not shown in the drawing is shifted to ON, a HQ mode, a one surface printing mode for performing a printing operation only for one surface of the printing paper 13 and a processing liquid non-usage mode for performing a printing operation without any use of the processing liquid are automatically set. Then, determination is made at a step S11 as to whether a both surface printing mode is selected or not. In the case that the operator shifts the both surface printing selection switch 41 to ON side, the program goes to a step S12 at which the present mode is shifted to the both surface printing mode. Next, the program goes to a step S13 at which determination is made as to whether a processing liquid usage mode is selected or not.

In the case that it is found at the step S13 that the processing liquid usage mode is selected, that is, in the case that determination is made at the step S13 such that the processing liquid usage switch 49 is shifted to ON by actuating the operator's hand, the program goes to a step S14 at which determination is made as to whether the HS mode is selected or not. In the case that it is found at the step S14 that the HS mode is selected, that is, in the case that determination is made at the step S14 such that the high speed printing selection switch 48 is shifted to ON by actuating the operator's hand, the program goes to a step S15 at which a both surface printing operation is performed in the HS mode for which the processing liquid head 26 is additionally used. When the HS mode is selected, an ink ejecting quantity is reduced in excess of the ink ejecting quantity corresponding to original image information. For this reason, an ink density with which a printing operation is performed on the printing paper 13 is thinned to less than that for a normal printing operation. Consequently, an occurrence that a printed image is recognized on the rear surface of the printing paper is attenuated, whereby an excellent printing quality is assured. Additionally, since the processing liquid is used for each printing operation, the waterproofness of an image formed on the printing paper 13 is improved.

In addition, in the case that the HS mode is not selected at the step S14, that is, in the case that determination is made at the step S14 such that the high speed printing selection switch 48 is shifted to OFF, the program goes to a step S16 at which both surface printing operation is performed in the HQ mode additionally using the processing liquid head 26. In this HQ mode, a quantity of ink corresponding to the original image information is ejected from the ink jet head 25. Thus, the ink density with which a printing operation is performed for the printing paper 13 is thickened much more than that corresponding to the HS mode. Consequently, a degree of sharpness of an image is improved. In this case, since the processing liquid is applied to the printing paper 13, an occurrence that the printed image is recognized on the rear surface of the printing paper 13 is suppressed, whereby a very excellent printing quality is assumed.

At each of the steps S15 and S16, since drying of the processing liquid and the ink is promoted by allowing the heating plates 18 and 40 and the infrared lamp 27 to be turned on, excellent printing quality can be maintained.

In addition, in the case that the processing liquid usage mode is not selected at the step S13, that is, in the case that determination is made at the step S13 such that the processing liquid usage selection switch 49 is shifted to OFF, the program goes to a step S17 at which both surface printing operation is performed in the HS mode not using processing liquid. In this HS mode, an occurrence that the image printed with the ink is recognized on the rear surface of the printing paper is attenuated by reducing a quantity of ejection of the ink to the printing paper 13 to less than that in the case of the HQ mode, whereby an excellent printing quality is maintained.

On the other hand, in the case that it is found at the step S11 that the both surface printing mode is not selected, that is, in the case that determination is made at the step S11 such that the both surface printing selection switch 41 is shifted to OFF, the program goes to a step 18 at which determination is made as to whether the processing liquid usage mode is selected or not. In the case that determination is made at the step 18 such that the processing liquid usage mode is selected, the program goes to a step 19 at which determination is made as to whether the HS mode is selected or not.

In the case that determination is made at the step 19 such that the HS mode is selected, that is, determination is made at the step 19 such that the high speed printing selection switch 48 is shifted to ON by operator's hand, the program goes to the step S15 at which the one surface printing operation additionally uses the processing liquid head 26.

In the case that it is found at the step 19 that the HS mode is not selected, that is, determination is made at the step S19 such that the high speed printing selection switch 48 is shifted to OFF, the program goes to the step 16 at which the one surface printing operation additionally uses the processing liquid head 26.

In the case that it is found at the step 18 that the processing liquid usage mode is not selected, that is, in the case that determination is made at the step S18 such that the processing liquid usage selection switch 49 is shifted to OFF, the program goes to a step S20 at which determination is made as to whether the HS mode is selected or not. Here, in the case that it is found at the step S20 that the HS mode is selected, that is, in the case that determination is made at the step S20 such that the high speed printing selection switch 48 is shifted to ON, the program goes to a step 17 at which the one surface printing operation is performed in the usual HS mode for which the processing liquid head 26 is not used. In addition, in the case that it is found at the step S20 that the HS mode is not selected, that is, in the case that determination is made at the step 20 such that the high speed printing selection switch 48 is shifted to OFF, the program goes to a step S21 at which the one surface printing operation is performed in the HS mode for which the processing liquid head 26 is not used.

At the steps S17 and S21, there does not arise a necessity that the heating plates 18 and 40 are turned on. However, since drying of the ink is promoted by turning on the infrared lamp 27, excellent printing quality is maintained at any rate.

Incidentally, the CPU 45 adapted to perform the aforementined processing may be constructed in such a manner as to function in response to a command issued from a host unit which is not shown in drawings. In the shown embodiment, a serial type ink jet head 25 is employed but it can be applied also to a full line type ink jet printing apparatus corresponding to the width of the printing paper 13.

Figure 4:
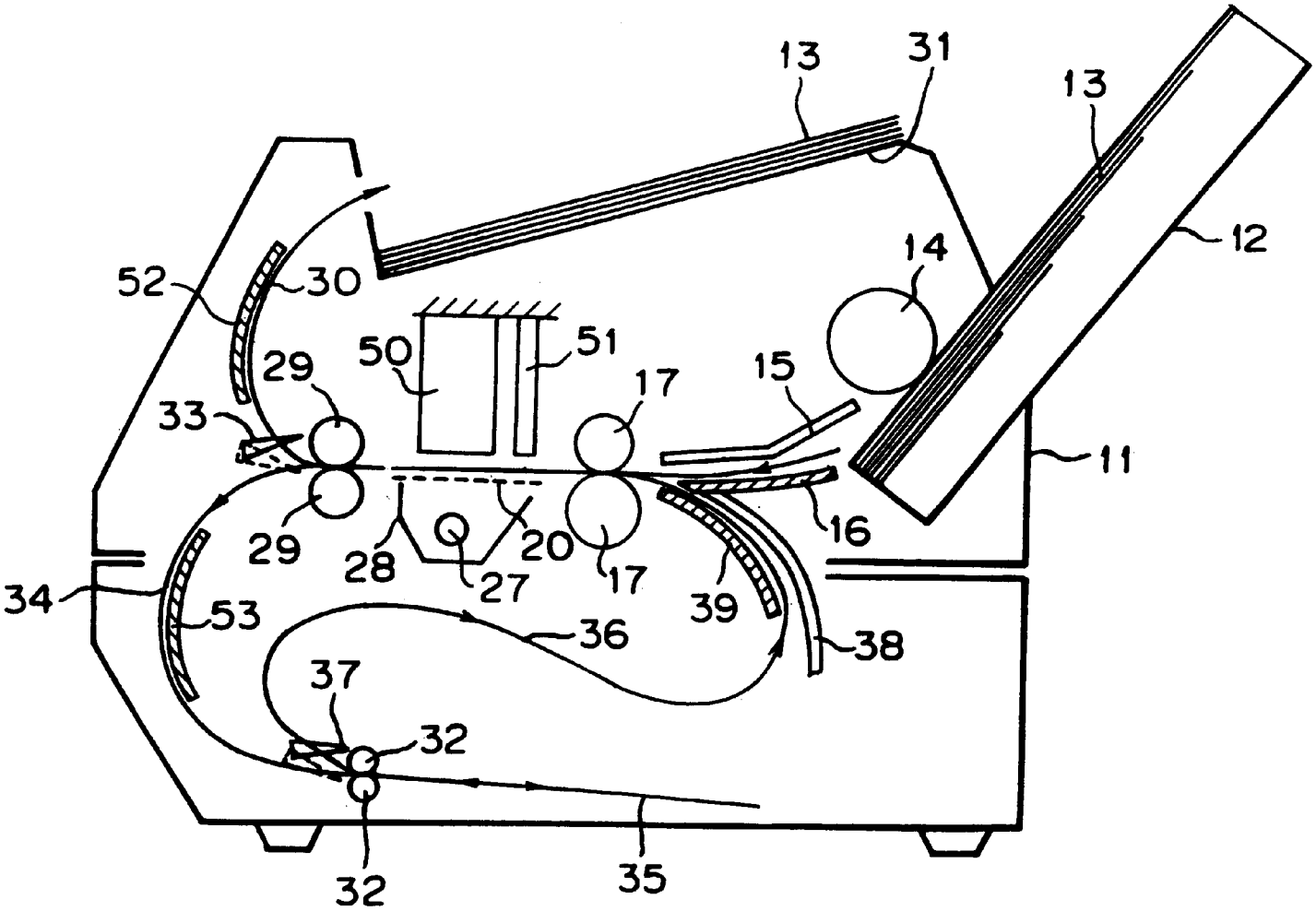
FIG. 4 is a vertical sectional view schematically showing the structure of an ink jet printing apparatus constructed in accordance with another embodiment of the present invention.
Figure 5:
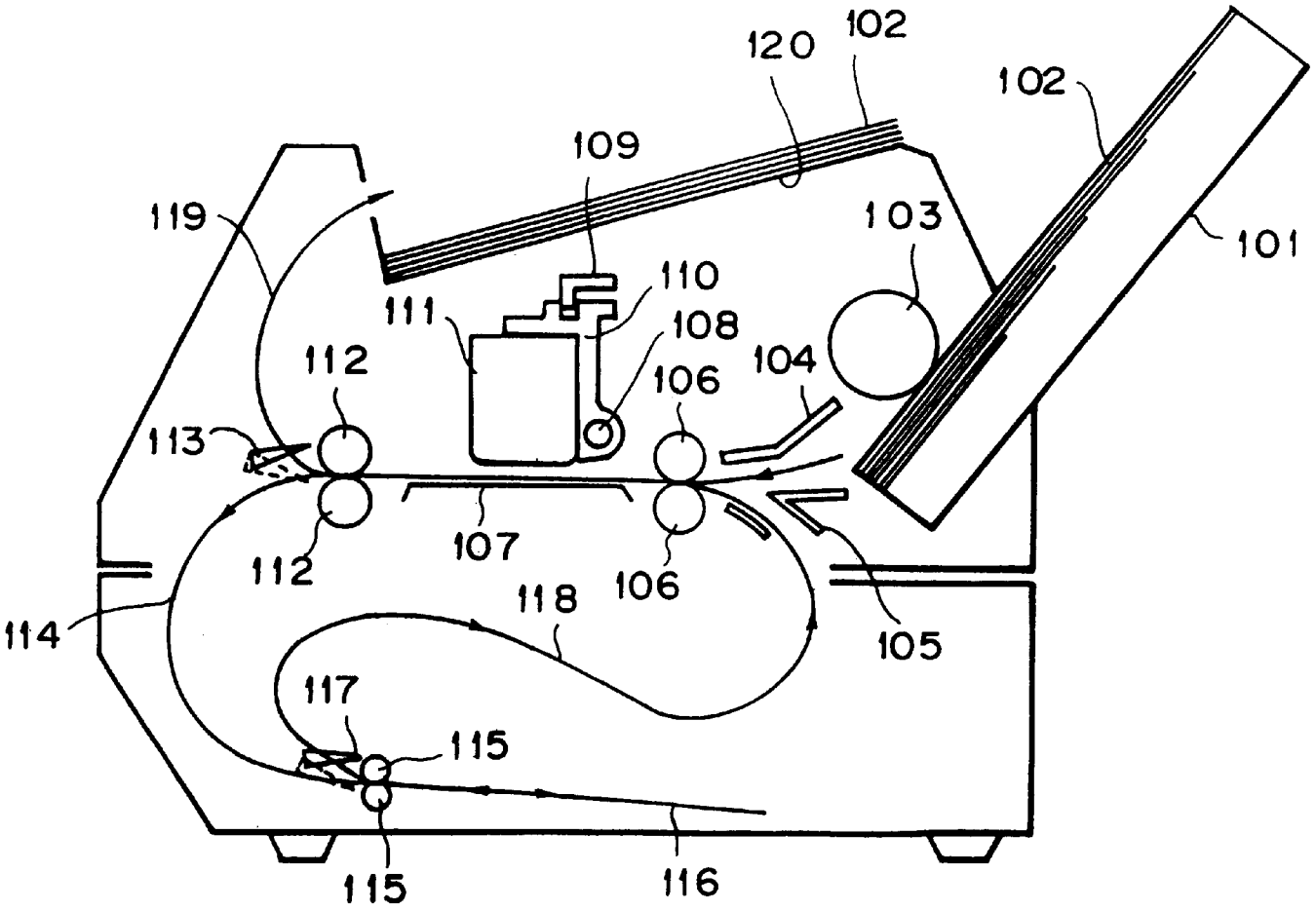
FIG. 5 (PRIOR ART)
FIG. 5 is a vertical sectional view schematically showing the structure of a conventional ink jet printing apparatus.
Figure 6:
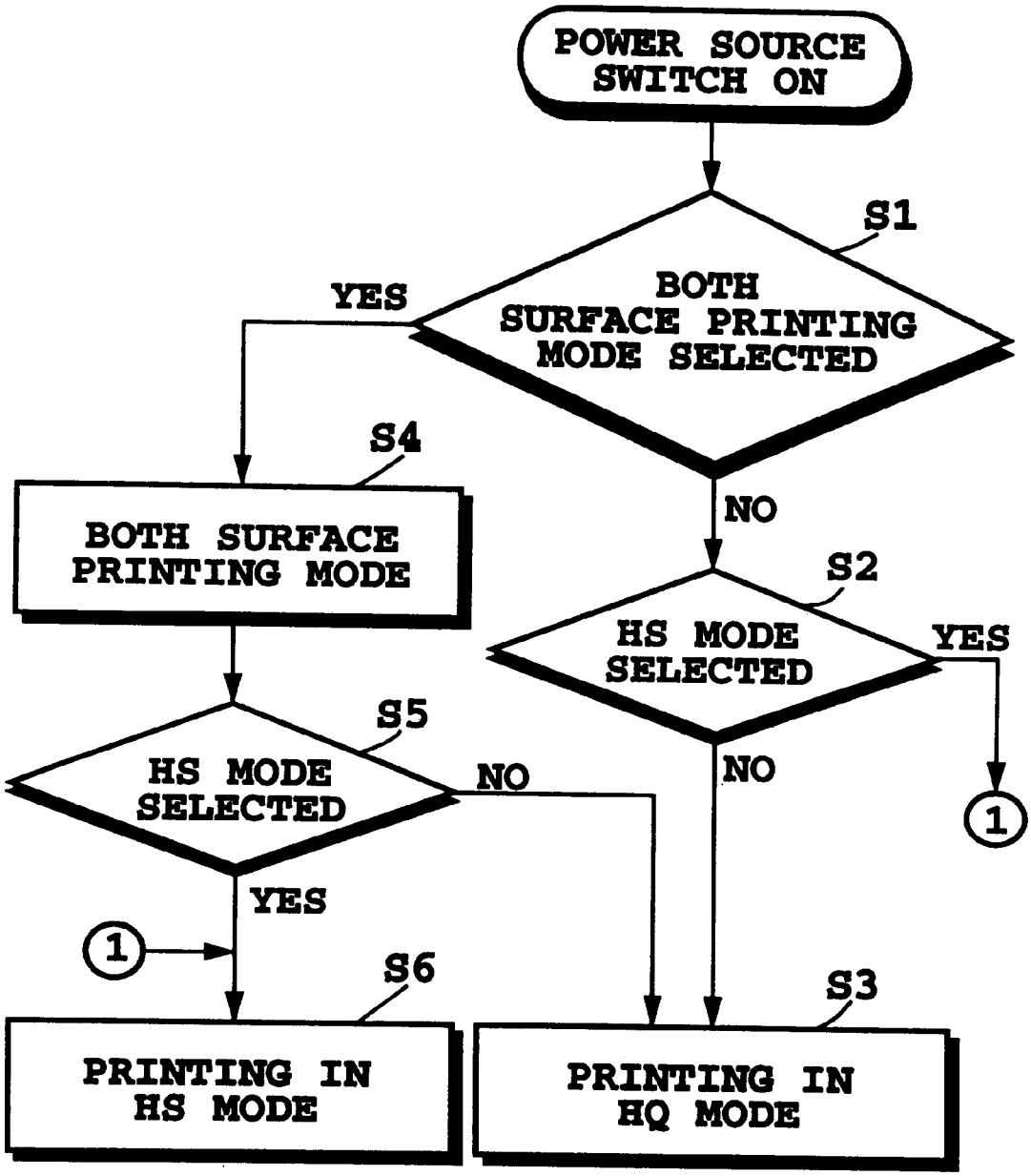
FIG. 6 (PRIOR ART)
FIG. 6 is a flowchart showing a flow of printing operations to be performed by the conventional ink jet printing apparatus shown in FIG. 5.

A schematic structure of the ink jet printing apparatus constructed in accordance with another embodiment of the present invention is shown in FIG. 4. In this embodiment, members each having a same function as that of the first embodiment are represented by same reference numerals, and repeated explanation on these members is eliminated for the purpose of simplification.

In detail, a full line type ink jet head 50 is arranged directly above the platen 20. A full line type processing liquid head 51 is arranged in the vicinity of the ink jet head 50 on the upstream side of the ink jet head 50 relative to the transporting direction of the printing paper 13.

In this embodiment, after the processing liquid is applied to a predetermined area of the printing paper 13 from the processing liquid head 51 by a quantity corresponding to one line, the usual printing operation is performed by the ink jet head 50 for the printing paper 13.

It should be noted that with respect to the full line type ink jet printing apparatus constructed in accordance with this embodiment, a conveying speed of the printing paper 13 can be set to a speed higher than that in the preceding embodiment. To this end, it is desirable that the output from the heating plates 18 and 40 and the infrared lamp 27 is raised up much more than that in the preceding embodiment or another heater is additionally arranged on the ink jet printing apparatus. From this viewpoint, in this embodiment, heating plates 52 and 53 having the same structure as that of the heating plates 18 and 40 are arranged midway of the paper discharging passage 30 as well as midway of the reversible conveying passage 34. While the heating plates 52 and 53 are turned on, drying of the ink is promoted by heating the printing paper 13 from the rear surface side after completion of each printing operation so that excellent printing quality of the printing paper 13 can be maintained.

What is claimed is:

1. An ink jet printing method of performing printing on both surfaces or one surface of a printing medium with the use of an ink jet head for ejecting ink, said method being capable of effecting a printing operation in a processing liquid usage mode for printing using processing liquid applied to the printing medium or in a low density mode for printing using a reduced quantity of ejection of the ink to the printing medium, said method comprising the steps of:

selecting either a both surface printing mode for printing on both surfaces of the printing medium or a one surface printing mode for printing on one surface of the printing medium, selecting either said processing liquid usage mode or said low density mode in a case that said both surface printing mode is selected, and printing on both surfaces of the printing medium in said selected processing liquid usage mode or low density mode.

2. An ink jet printing method as claimed in claim 1, wherein said processing liquid usage mode includes a high density printing mode with which a quantity of ejection of said ink to said printing medium is not reduced.

3. An ink jet printing method as claimed in claim 1, wherein said low density mode includes a processing liquid non-usage printing mode with which said processing liquid is not applied to said printing medium.

4. An ink jet printing method as claimed in claim 1, wherein said processing liquid serves to suppress penetration of said ink into said printing medium.

5. An ink jet printing method as claimed in claim 1, wherein said processing liquid serves to promote coagulation of said ink.

6. An ink jet printing method as claimed in claim 1 further comprising a step of heating said printing medium when said processing liquid is applied to said printing medium and/or when the printing operation is performed with said ink.

7. An ink jet printing method as claimed in claim 1, wherein said processing liquid is applied to said printing medium before the printing operation is performed with said ink.

8. An ink jet printing method as claimed in claim 7 further including a step of preheating said printing medium before said processing liquid is applied to said printing medium in the case that said processing liquid usage mode is selected.

9. An ink jet printing apparatus for printing on both surfaces or one surface of a printing medium with the use of an ink jet head for ejecting ink, comprising:

first designating means for designating either a both surface printing mode for printing on both surfaces of the printing medium or a one surface printing mode for printing on one surface of the printing medium, processing liquid applying means for applying processing liquid to the printing medium, density changing means for effecting a reduced quantity of ejection of the ink to the printing medium, and second designating means for designating either of said processing liquid applying means or said density changing means in the case that said first designating means designates said both surface printing mode.

10. An ink jet printing apparatus as claimed in claim 9, wherein said density changing means serves to reduce said quantity of ejection of said ink to said printing medium in excess of an original ink ejection quantity corresponding to image information.

11. An ink jet printing apparatus as claimed in claim 9, wherein said density changing means serves to maintain said quantity of ejection of said ink to said printing medium at an original ink ejection quantity corresponding to image information in a case that said processing liquid applying means is designated by said processing liquid and density designating means.

12. An ink jet printing apparatus as claimed in claim 9, wherein said processing liquid applying means does not apply said processing liquid to said printing medium in the case that said density changing means is designated by said second designating means.

13. An ink jet printing apparatus as claimed in claim 9, wherein said processing liquid serves to suppress penetration of said ink into said printing medium.

14. An ink jet printing apparatus as claimed in claim 9, wherein said processing liquid serves to promote coagulation of said ink.

15. An ink jet printing apparatus as claimed in claim 9, further comprising a main heater for heating said printing medium when said processing liquid is applied to said printing medium and/or when a printing operation is performed with said ink.

16. An ink jet printing apparatus as claimed in claim 9, wherein said processing liquid is applied to said printing medium before a printing operation is performed with said ink.

17. An ink jet printing apparatus as claimed in claim 16, further including a preheater for preheating said printing medium before said processing liquid is applied to said printing medium.

18. An ink jet printing apparatus as claimed in claim 9, wherein said ink jet head can move along said printing medium in a direction intersecting a conveying direction of said printing medium.

19. An ink jet printing apparatus as claimed in claim 9, wherein said ink jet head can simultaneously eject said ink over the whole width of the printing range of said printing medium.

* * * * *

UNITED STATES PATENT AND TRADEMARK OFFICE

CERTIFICATE OF CORRECTION

PATENT NO. : 6,012,809

DATED : January 11, 2000

INVENTOR(S) : IKEDA ET AL.

It is certified that error appears in the above-identified patent and that said Letters Patent is hereby corrected as shown below:

COLUMN 4:
Line 10, "the" should be deleted.
Line 11, "enabling" should read --enabling the--.

COLUMN 7:
Line 4, "together, dissolved, and" should read --together and dissolved, the--.

COLUMN 13:
Line 42, "much" should read --to much--.

COLUMN 15:
Line 51, "claim 1" should read --claim 1,--.
Line 59, "claim 7" should read --claim 7,--.

COLUMN 16:
Line 27, "processing liquid and density" should read --second--.

Signed and Sealed this

Sixth Day of March, 2001

*Attest:*

Nicholas P. Godici

NICHOLAS P. GODICI

*Attesting Officer*

*Acting Director of the United States Patent and Trademark Office*